US010596450B2

(12) United States Patent
Lattin et al.

(10) Patent No.: US 10,596,450 B2
(45) Date of Patent: Mar. 24, 2020

(54) MAGNETIC TOSS GAME

(71) Applicant: Dipole Games, LLC, St. Paul, MN (US)

(72) Inventors: Robert Lattin, Minneapolis, MN (US); Todd Lutkauskas, St. Paul, MN (US); Sesha Madireddi, St. Charles, MO (US)

( * ) Notice: Subject to any disclaimer, the term of this patent is extended or adjusted under 35 U.S.C. 154(b) by 0 days.

(21) Appl. No.: 14/832,809

(22) Filed: Aug. 21, 2015

(65) Prior Publication Data

US 2016/0107078 A1 Apr. 21, 2016

Related U.S. Application Data

(60) Provisional application No. 62/040,208, filed on Aug. 21, 2014.

(51) Int. Cl.

| | |
|---|---|
| ***A63F 9/02*** | (2006.01) |
| ***A63F 7/00*** | (2006.01) |
| ***A63B 67/06*** | (2006.01) |

(52) U.S. Cl.

CPC ..... *A63F 9/0208* (2013.01); *A63B 67/06* (2013.01); *A63F 7/0088* (2013.01)

(58) Field of Classification Search

CPC ..... A63F 9/0208; A63F 7/0088; A63B 67/06
USPC ..... 273/239, 260, 261, 331, 348, 348.3, 273/348.4, 348.5

See application file for complete search history.

(56) References Cited

U.S. PATENT DOCUMENTS 1,536,436 A * 5/1925 Kolinski ..... F41J 7/04 273/393
1,888,980 A * 11/1932 Dingledine ..... A63F 3/00075 273/239
2,282,871 A * 5/1942 Malbon ..... A63F 3/00697 273/282.2
2,657,059 A * 10/1953 Selig ..... A63F 3/08 221/212
2,665,912 A * 1/1954 Juran ..... A63F 7/0088 273/118 A
2,702,191 A * 2/1955 Lemelson ..... F41J 7/04 24/303
2,819,904 A * 1/1958 Nelson ..... A63F 3/00694 273/239
2,928,677 A * 3/1960 McAdam ..... A63F 9/0208 273/348.3
3,118,669 A * 1/1964 Merrill ..... A63H 33/26 273/348.3
3,147,976 A * 9/1964 Millar ..... F41J 3/0057 273/348.3
3,194,561 A * 7/1965 Schumann ..... A47B 25/00 273/239

(Continued)

*Primary Examiner* — Vishu K Mendiratta
(74) *Attorney, Agent, or Firm* — Greg N. Geiser; Gutwein Law

(57) ABSTRACT

A magnetic toss game with a three-dimensional target capable of generating a magnetic field, a support mechanism having two ends, the first end operably coupled to the three-dimensional target, and a three-dimensional backdrop having at least one side surface and a bottom surface, the three-dimensional backdrop spaced apart from the three-dimensional target and operably coupled to the support mechanism, wherein the three-dimensional backdrop envelops the three-dimensional target on at least two sides, including the bottom side.

14 Claims, 17 Drawing Sheets

(56) References Cited

U.S. PATENT DOCUMENTS 3,210,080 A * 10/1965 Rael ..... A63F 3/00694 273/148 R
3,232,620 A * 2/1966 Schoolcraft ..... A63F 3/00028 273/239
3,359,003 A * 12/1967 Kass ..... A63F 3/00176 273/239
3,495,829 A * 2/1970 Booth ..... D06P 1/6426 273/371
3,653,662 A * 4/1972 Welbourn ..... A63F 7/047 273/400
3,791,649 A * 2/1974 Gold ..... A63F 3/00214 273/239
3,817,528 A * 6/1974 Stuhler ..... F41J 1/10 273/393
4,036,493 A * 7/1977 Breslow ..... A63F 9/26 273/456
4,172,597 A * 10/1979 Smith ..... A63F 3/062 273/148 R
4,272,075 A * 6/1981 Rogers, Jr. ..... A63F 9/305 273/140
4,305,587 A * 12/1981 O'Grady ..... A63F 9/0208 273/348.3
5,209,486 A * 5/1993 Brotz ..... A63B 67/06 273/129 R
5,265,885 A * 11/1993 Blount ..... A63F 9/34 273/239
5,328,188 A * 7/1994 Brotz ..... A63B 67/06 273/129 R
7,163,204 B1 * 1/2007 Liao ..... F41J 5/04 273/348.3
7,264,248 B2 * 9/2007 Stoddart ..... A63B 67/10 273/456
2007/0045952 A1 * 3/2007 Jones ..... A63F 3/00697 273/236
2011/0070983 A1 * 3/2011 Yukihiro ..... A63F 9/02 473/615
2013/0168925 A1 * 7/2013 Morgan ..... A63B 67/06 273/348.3

* cited by examiner

MAGNETIC TOSS GAME

CROSS REFERENCE TO RELATED APPLICATIONS

This application claims priority to U.S. Provisional Patent Application No. 62/040,208 filed 21 Aug. 2014 to the above named inventors, and is herein incorporated by reference in its entirety.

FEDERALLY SPONSORED RESEARCH

Not Applicable

SEQUENCE LISTING OR PROGRAM

Not Applicable

TECHNICAL FIELD

The present invention relates generally to games. More particularly, the present invention relates to a magnetic toss game, in which at least one metalized or ferromagnetic piece, such as a bottle cap, is thrown from a predetermined distance at a target with a magnetic field with the goal of adhering to the metalized or ferromagnetic piece to the target.

BACKGROUND OF THE INVENTION

Eye hand coordination is a skill that is useful in a myriad of human occupations and pastimes. The tossing of darts or game pieces towards a target surface or object, such as a flat surface, a wall or a vertical post may help develop eye-hand coordination as well as provide entertainment value. Some examples of such games include darts, washers, and bean-bag toss.

Given the dangers involved in throwing sharpened objects, such as a dart, safety restrictions may limit the demographic appeal of some games to individuals with good dexterity, as well as limit the environment in which the game can be safely played. Accordingly, oftentimes youth and those with physical limitations, such as elderly or handicapped players are excluded from the game. Safety concerns are magnified when alcohol is available to the players or spectators. For these and other considerations, a number of games have been developed which involve magnetically charged game pieces that adhere against a surface that is magnetically attractive to the game pieces.

For example, U.S. Pat. No. 6,116,605, entitled "Magnetic Toss Game" discloses a toss game where the planer target surface simulates known sports goals and magnetized playing pieces simulate known paraphernalia, such as balls, pucks, golf balls, footballs, basketballs, and soccer balls. In use, a user throws the playing pieces at a target in an attempt to adhere magnetized playing pieces to a generally planer target surface. U.S. Patent Publication No. 2013/0001879, entitled "Method and System of Magnetic Toss Gaming" discloses a similar two-dimensional magnetically attractive planar target surface in which a substantively flat magnetically charged disc are tossed.

Although the above-mentioned inventions overcome the limitations of games involving the throwing of sharpened objects, they are limited in that the target is two-dimensional or planar, instead of three-dimensional or shaped. If a target could be three-dimensional or shaped it could offer an increased challenge to players of the game, as with a three-dimensional or shaped target, certain regions of the target board could be harder to adhere to a magnetized game piece than others. Similarly, with a target of only two-dimensions, subtleties of the playing piece landing orientation are not part of the game. Lack of a three-dimensional target also limits the game from being played from a variety of angles.

The above-mentioned inventions are also limited in that the playing pieces are magnetized. Requiring the playing pieces to be magnetized adds to the overall cost of the game, as well as reducing the interchangeability of the playing pieces. For example, if the relatively small playing pieces are lost, the game could be rendered unusable if a playing piece of similar weight, size and magnetic force is not located.

The above-mentioned inventions also lack a means of catching the playing pieces if they fail to adhere to the target. Because of this noted absence, if a user throws a playing piece at the target and it misses or bounces off the target, the user will be forced to keep track of where the playing piece landed for later retrieval. Because the playing pieces can be relatively small in size, there is an increased chance that the pieces can be lost without a means of catching the pieces.

Accordingly, there is a need for a game that has a three-dimensional target, which does not require throwing sharpened or magnetized playing pieces, and has a means to catch playing pieces that are thrown, but fail to adhere to the target.

SUMMARY OF THE INVENTION

The present invention provides embodiments of a magnetic toss game, in which at least one metalized or ferromagnetic piece, such as a bottle cap, is thrown from a predetermined distance at a three-dimensional or shaped target having a magnetic field with the goal of adhering the metalized or ferromagnetic piece to the target. The present invention provides embodiments of a magnetic toss game, which includes a three-dimensional backdrop capable of catching the thrown metalized or ferromagnetic piece if it should fail to adhere to the three-dimensional or shaped target.

The embodiments of the magnetic toss game include a three-dimensional target, and may include a support mechanism and/or a three-dimensional backdrop. The three-dimensional target is capable of generating a magnetic field. The magnetic field of the target possesses unique features to promote game playability. These features include sufficient field strength not only at the surface of the target but also, the radiated magnetic field around the target possesses enough strength to actively attract the thrown object while the projectile is in flight. This invention also balances the magnetic field strength so it is not too strong. In cases where the magnetic field strength is too strong, the playing piece tends to land with its broadest side against the magnet thereby limiting variation of playing piece orientation against the target. Higher scoring may be assigned to more unlikely landing orientations so variations in the landing orientation is desirable for game play.

In addition, to balance the magnetic field strength between strong enough at a distance to attract the playing piece, but not too strong to limit landing orientations, the magnetic field generally has varying strength and polarity in different regions of the target, thereby making regions of the target either easier or harder to successfully land a playing piece. In this case, successfully landing the playing piece in regions of weaker magnetic field strength may result in a higher score for the play. Covering the magnetic target with a sheath or covering with impact properties tailored specifically for game playability may further enhance the game challenge. This elastic damping coefficient of the covering may be adjusted to deaden the impact of the playing piece against the attracting magnet and thereby enhance the adherence of the playing piece to the target or, the covering may elastically repel the playing piece on impact. Different regions of the target may have covering materials with varying properties to either deaden the impact or elastically repel the playing piece.

One example of this is to increase the damping coefficient of the covering where the magnetic field strength is weak thereby improving the chance of the playing piece adhering to the target and reducing the damping coefficient where the field strength is relatively high thereby increasing the likelihood that the playing piece is elastically repelled from the target. Such modifications would tend to make the likelihood of a playing piece successfully adhering to the target more uniform across the surface of the target even though the magnetic field strength varies. The reverse may also be implemented to favor or make certain regions of the target more challenging to land. In addition to the function of the covering during normal game play, the covering has a dual function to protect the generally brittle magnet from impact. Of course, a covering may be applied to the playing pieces instead or in addition to the covering on the target with tailored elastic properties to similarly affect adhesion and enhance game playability.

The support mechanism, when used, has two ends. The first end of the support mechanism is operably coupled to the three-dimensional target, and the second end of the support mechanism includes an attachment mechanism capable of selective coupling the support mechanism to a fixed reference point. The three-dimensional backdrop, when used, has at least one side surface and generally a bottom surface which can be an extension of the side surface. The three-dimensional backdrop, when used, is spaced apart from the three-dimensional target and may be operably coupled to the support mechanism. The three-dimensional backdrop may be shaped such that it envelops the three-dimensional target on at least two sides, including the bottom side. The three dimensional back drop may be shaped such that it encompasses only one side and makes use of another feature available in the immediate environment such as a table top, the mounting stand, an adjacent wall, sports jersey, floor surface or a combination of items. The three-dimensional backdrop can be shaped or printed in a manner to promote a particular theme or to advertise products or services. The three-dimensional backdrop, preferably includes a bottom portion forming a tray, the tray designed for the collection and receipt of tossed playing pieces that miss the target. The backdrop and tray can be easily folded for transport and used to encompass the target, playing pieces, and support stand, wherein the backdrop forms and enclosure for the transport of the game. The at least one metalized or ferromagnetic playing piece can also be shaped or printed in a manner to promote a particular theme or to advertise products or services.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The invention can be more completely understood in consideration of the following detailed description of various embodiments of the invention, in connection with the accompanying drawings, in which.

Figure 1:
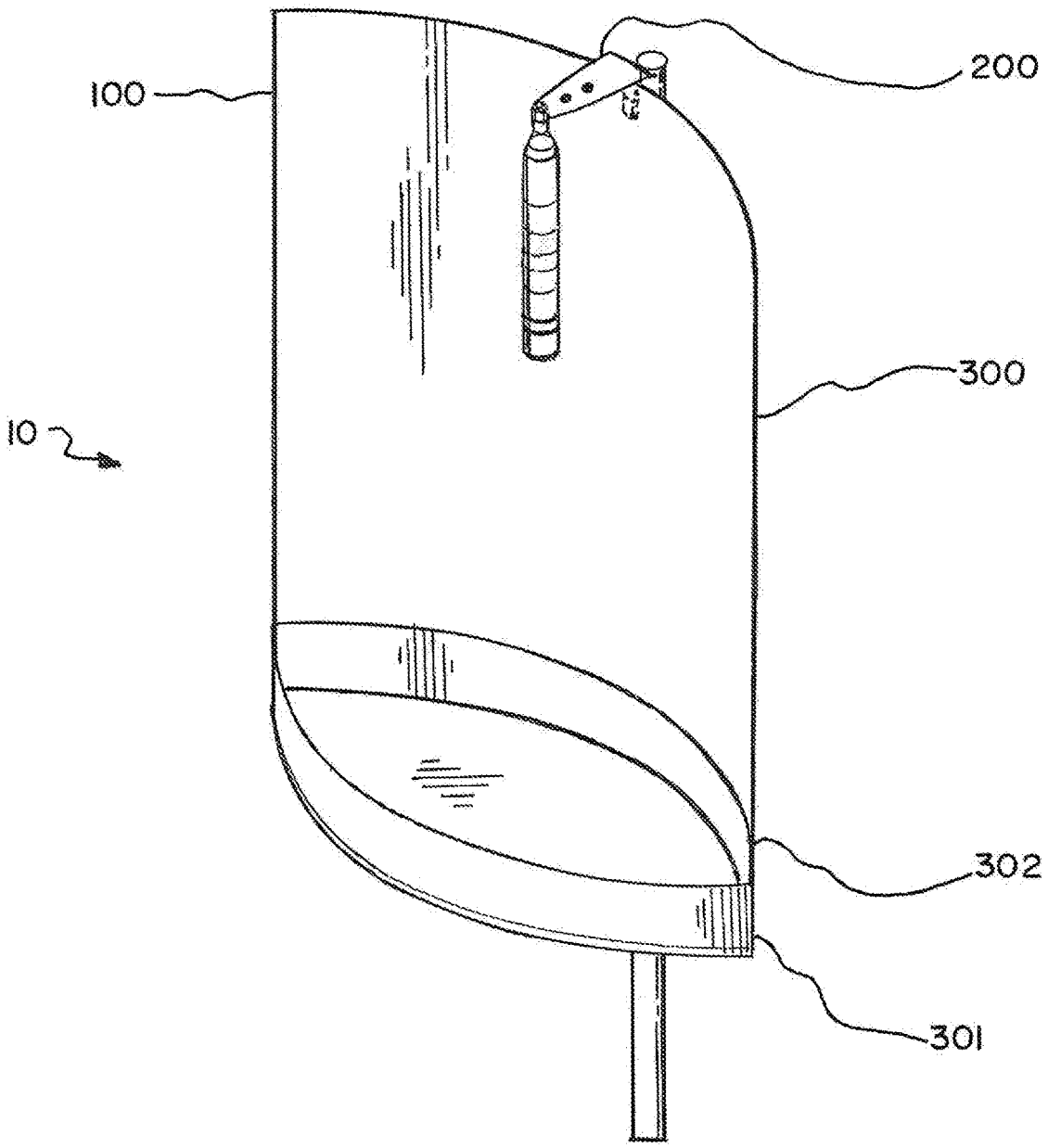
FIG. 1 is an isometric view of a magnetic toss game in accordance with an example embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

Referring to FIG. 1, magnetic toss game 10 according to an embodiment of the invention is depicted. The magnetic toss game 10 includes a three-dimensional target 100, a support mechanism 200, a three-dimensional backdrop 300, and a metalized or ferromagnetic playing piece 400. The three-dimensional target 100 is capable of generating a magnetic field and may include designated and segregated scoring regions.

Figure 2A:
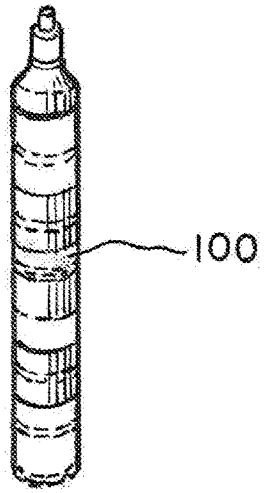
FIGS. 2A-H are views of three-dimensional targets in accordance with example embodiments of the invention.
Figure 2B:
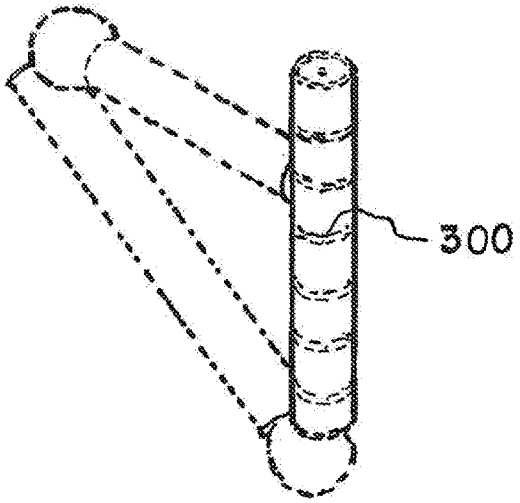
Figure 2C:
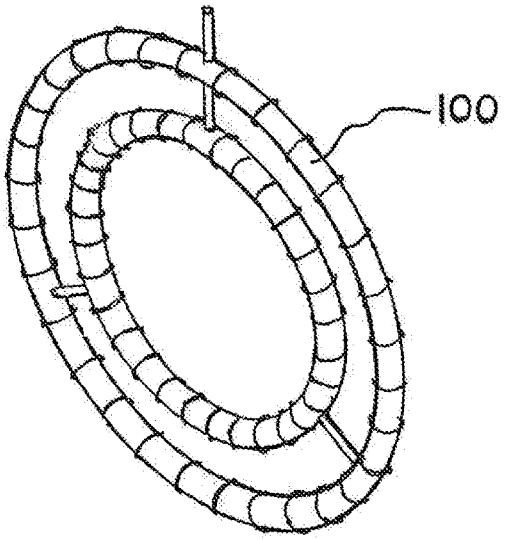
Figure 2D:
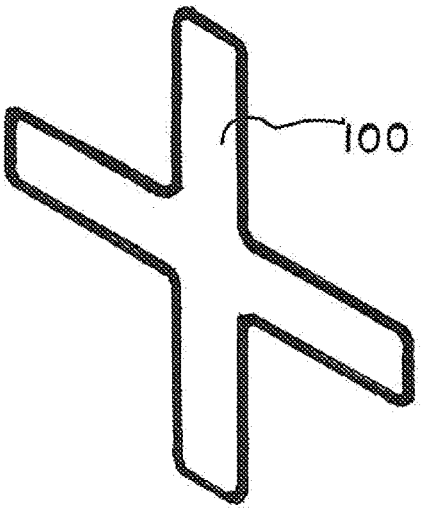
Figure 2E:
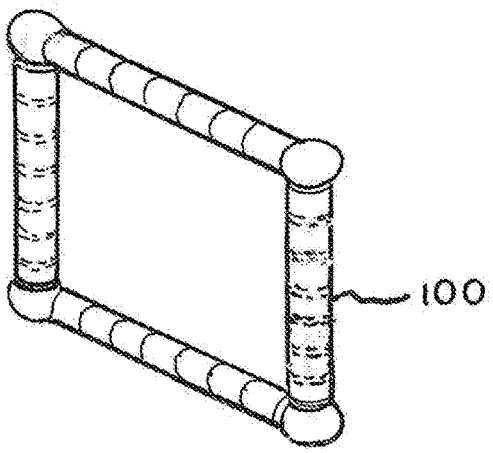
Figure 2F:
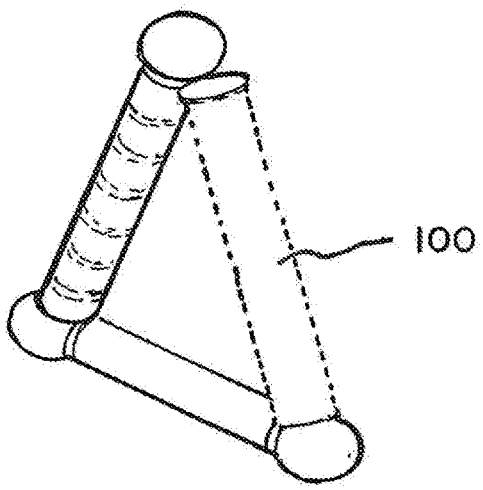
Figure 2G:
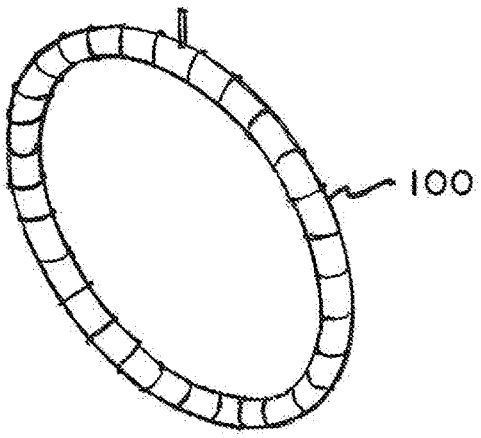
Figure 2H:
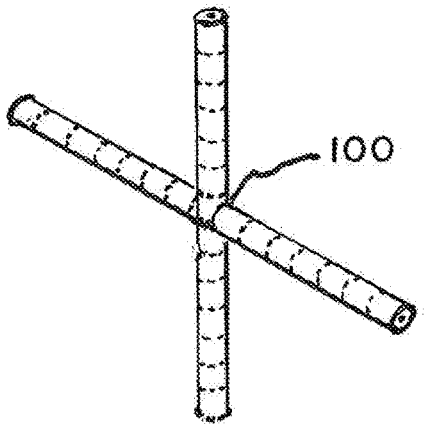
Figure 3:
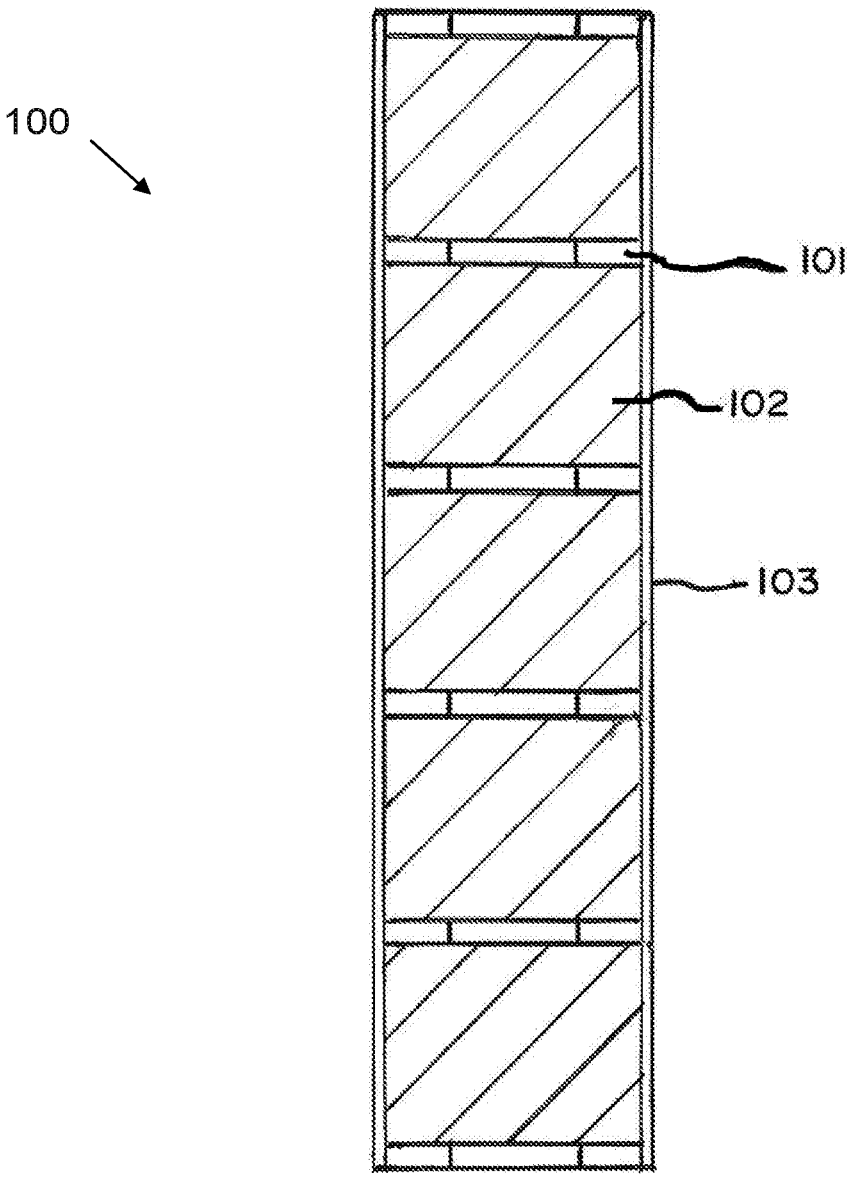
FIG. 3 is a plan view of a three dimensional target in accordance with an example embodiment of the invention.
Figure 13A:
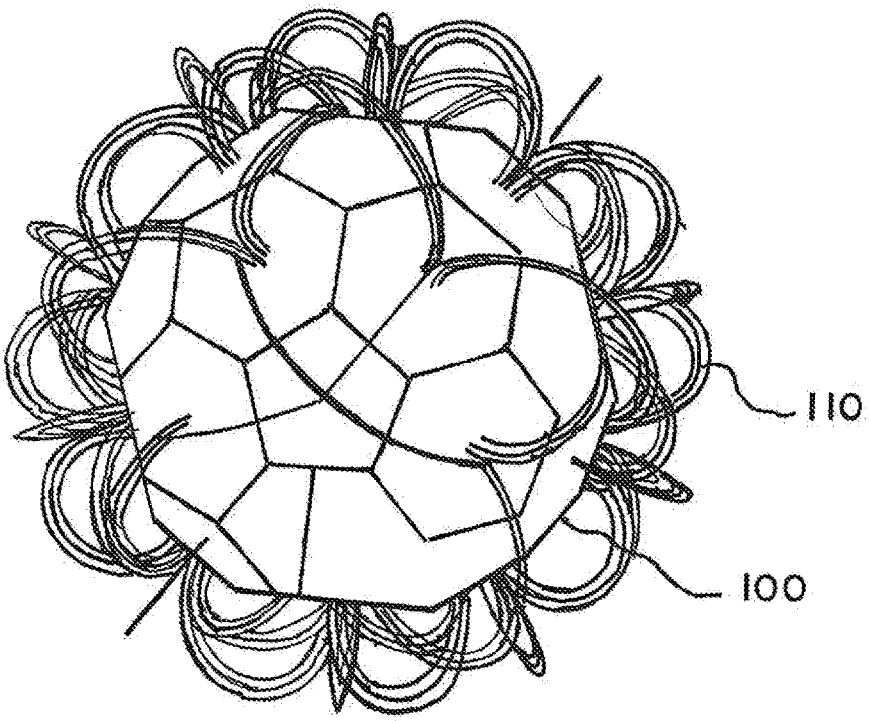
FIG. 13A-B is an isometric view of a three-dimensional spherical shaped target resembling a soccer ball, in accordance with an example embodiment of the invention.
Figure 13B:
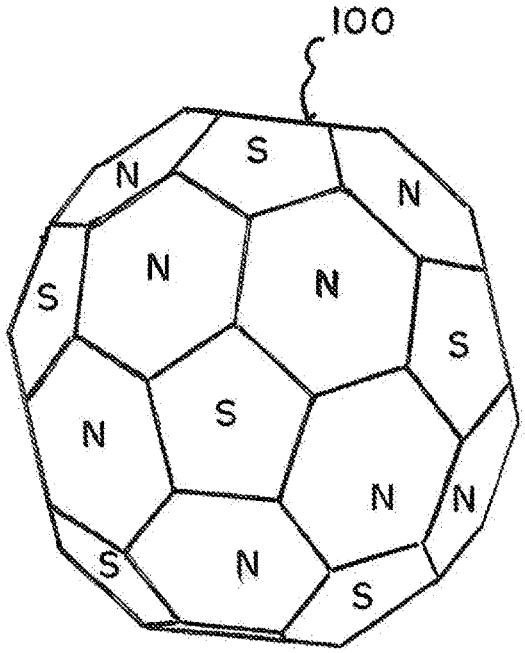

Referring to FIG. 2A-2H, the three-dimensional target 100 can be cylindrical in shape (FIG. 2A) or additional magnetic elements can be added to form additional shapes to increase the difficultly or alter the game play. These three-dimensional target 100 shapes can include, but not be limited to, triangles (FIG. 2B, FIG. 2F), circles (FIG. 2G) or concentric circles (FIG. 2C), crosses (FIG. 2D, FIG. 2H), square (FIG. 2E). In another embodiment, the target can be comprised of a plurality of smaller targets, for example the target could be a pyramid of balls. In another embodiment, the target can be moveable or flexible, for example the target could be as series of rigid segments in the shape of a snake with joints between rigid segments to facilitate movement. In another embodiment, the target can be shaped like a physical representation of well-known objects such as a sports ball (FIG. 13A-B), model airplane, automobile, etc.

Referring to FIGS. 3-7, three-dimensional target 100 is capable of generating a magnetic field 110. In some embodiments, the target 100 can be constructed of one or more permanent magnets 101. Magnets 101 can be positioned so that opposite ends are together (North-South "N-S") (see FIG. 5A-B), or the magnets 101 can be positioned so that like ends are together (N-N) (see FIG. 6A-B). Metalized or ferromagnetic spacers 102 (as depicted in FIG. 4A) can be used to increase the size, or modify the shape of the target 100 to minimize the need for large or numerous magnets or electrical elements. Metalized or ferromagnetic spacers 102 can also be used to create a variety of magnetic field configurations. In one configuration a thin inner magnet 101 placed in a vertical direction can be surrounded by magnetically permeable poles (FIG. 6C) or the magnets 101 can be discs placed in a horizontal direction with soft iron poles (FIG. 6D). Additionally, booster magnets 113 may be added to configurations to allow for special scoring zones or a boost to magnetic strength. An external covering, sheath or shield 103 on the target 100 can alter the magnetic field 110 of the target 100 such that it modifies the magnetic field 110 spatial distribution to interrupt or concentrate the magnetic field 110 in particular regions.

In the preferred embodiment of the present invention, the target 100 utilizes a thin permanent magnet 101, of the rare earth type, adjacent to the magnetically permeable spacer 102 of ANSI 1008 steel. Accordingly, the magnet 101 and spacer 102 are in a stacked configuration to create a larger magnetic body from a minimal of permanent magnet materials 101. Accordingly, the magnet 101 and spacer 102 can be solid or have apertures to reduce material and weight.

The covering or shield 103 can be colored, optically reflective, have different degrees of permeability, offer cushioning or have an elasticity, and can have other lighted (LED light) features such to be coded to resist/repel and/or attract a certain color. In one embodiment, the target 100 may have LED lights within the target and the LED lights may be directly visible by the player and/or the light may be conducted to specific regions of the target via light pipe within the target 100. LED lights may be lit continuously or may operate selectively to add interest, signal information to a player or distract the player. In one embodiment, a series of permanent magnets 101 shaped like rings or washers can be spaced apart by metalized or ferromagnetic spacers 102 and held together by a single nut and bolt or, the series of magnets and spacers can have a solid core with the whole assembly being held together by adhesive between the individual segments or, the external covering 103.

Figure 4A:
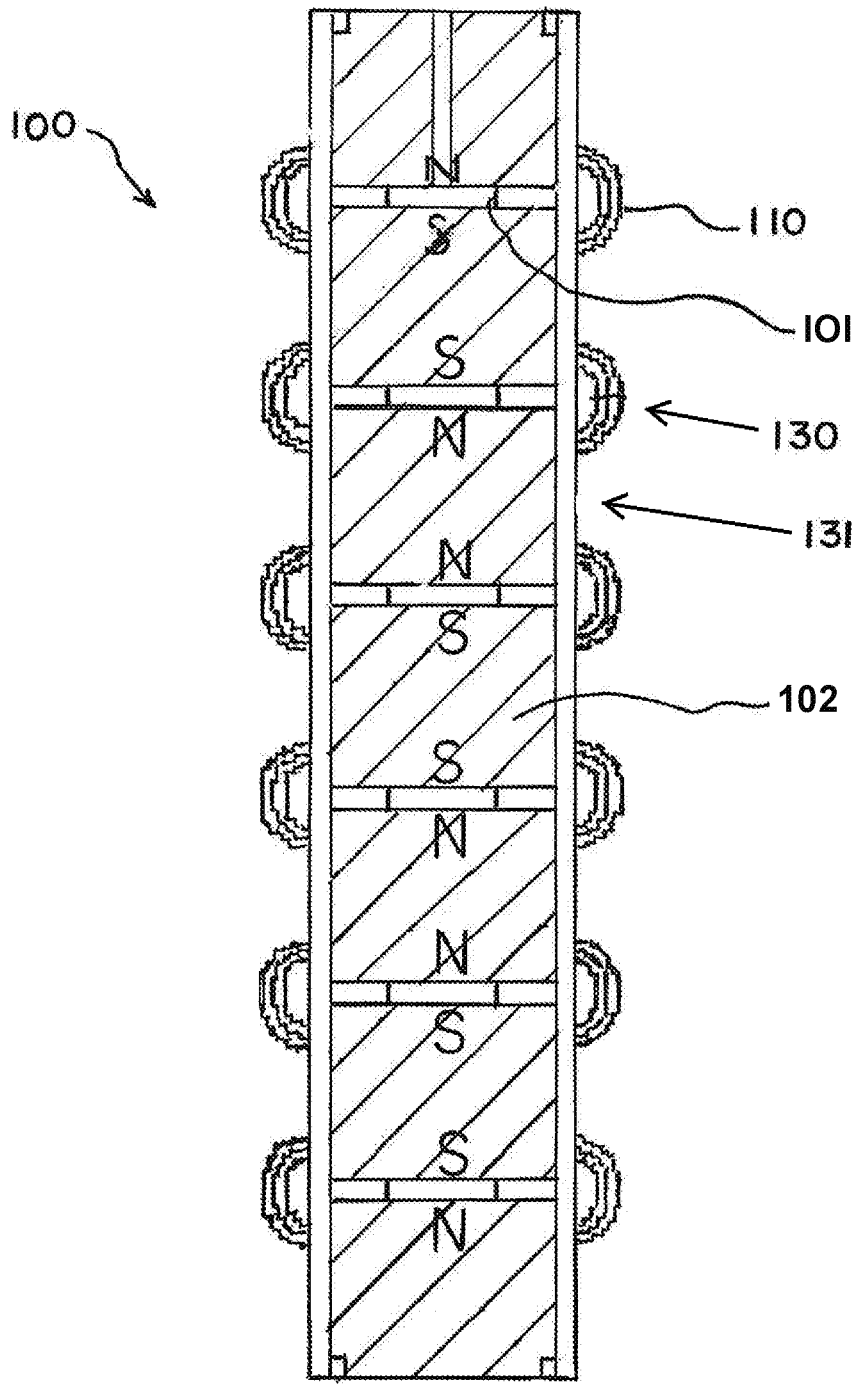
FIG. 4A-B are a plan views of a three dimensional targets in accordance with example embodiments of the invention.
Figure 4B:
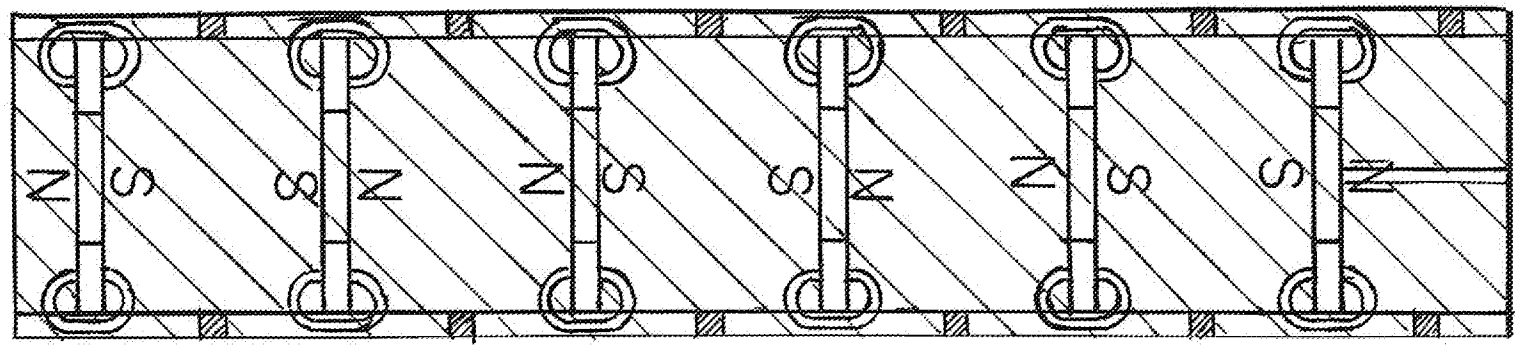
Figure 5A:
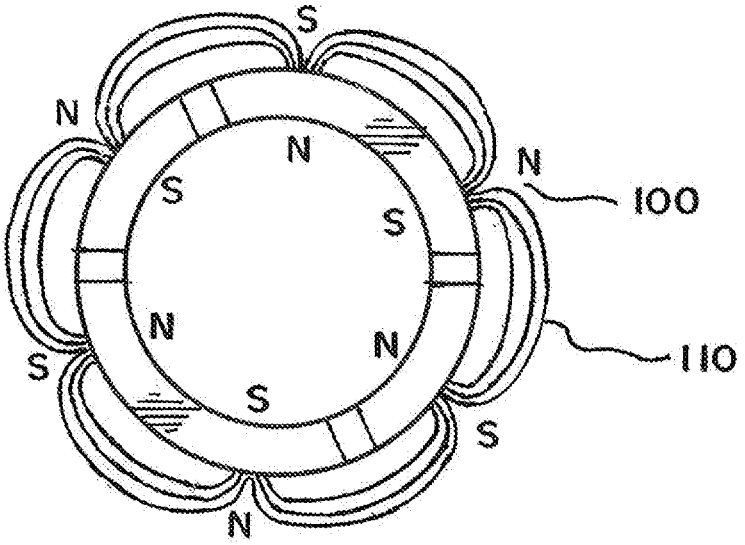
FIG. 5A is a top view of a three dimensional target with the magnetic field shown, in accordance with an example embodiment of the invention.
Figure 5B:
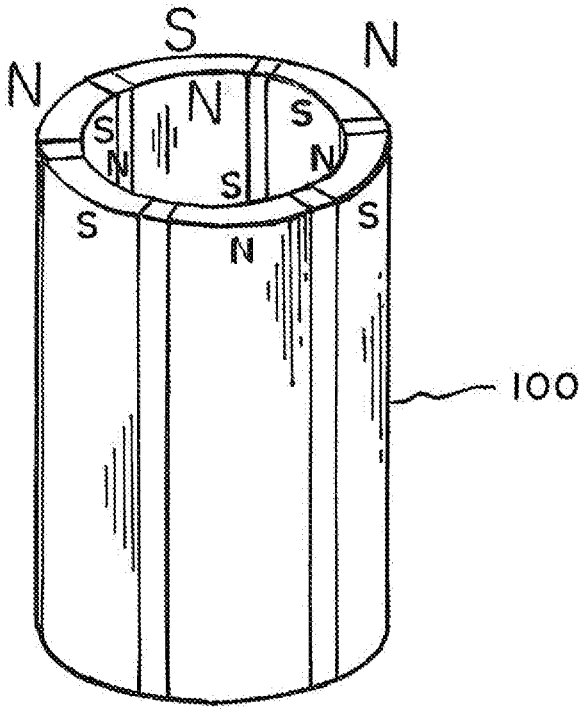
FIG. 5B is a isometric view of a three dimensional target as shown in FIG. 5A, in accordance with an example embodiment of the invention.
Figure 6A:
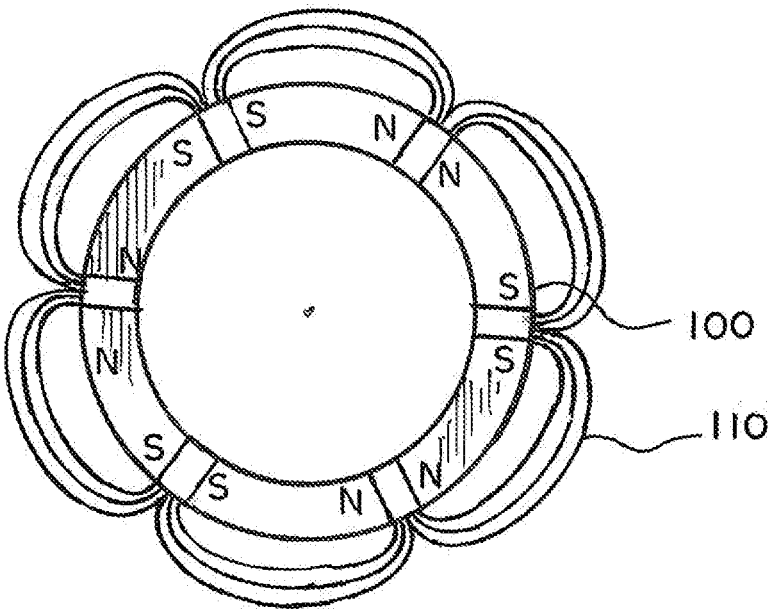
FIG. 6A is a top view of a three dimensional target with the magnetic field shown, in accordance with an example embodiment of the invention.
Figure 6B:
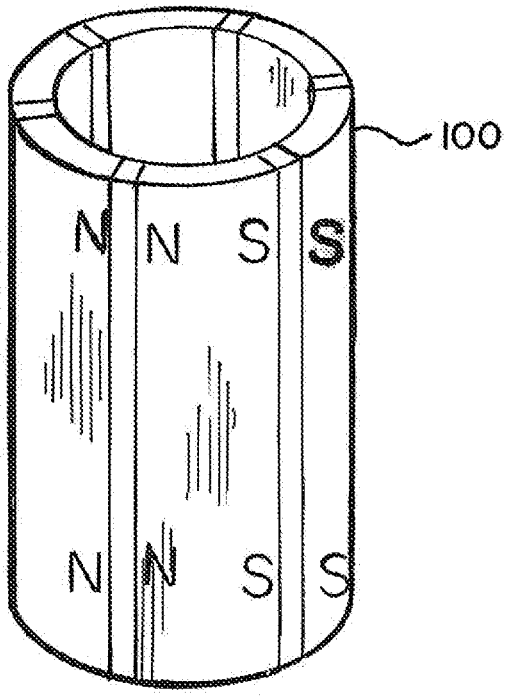
FIG. 6B is a isometric view of a three dimensional target as shown in FIG. 6A, in accordance with an example embodiment of the invention.
Figure 6C:
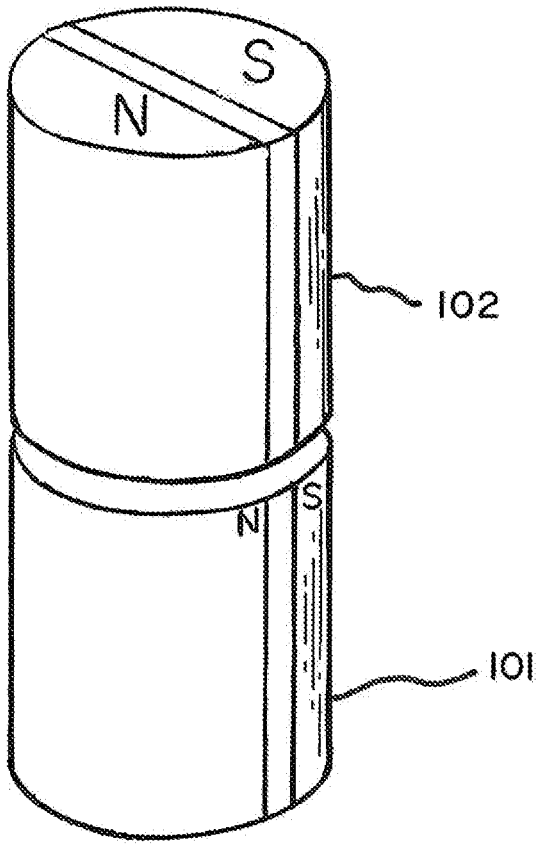
FIGS. 6C-D are an isometric view of a three dimensional target in accordance with an example embodiment of the invention.
Figure 6D:
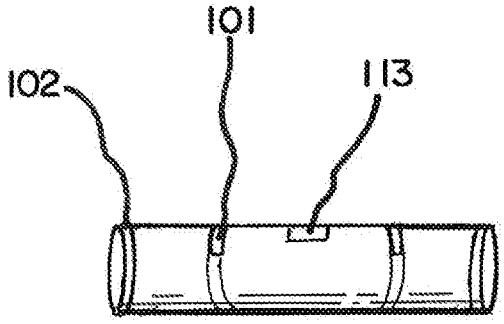
Figure 7A:
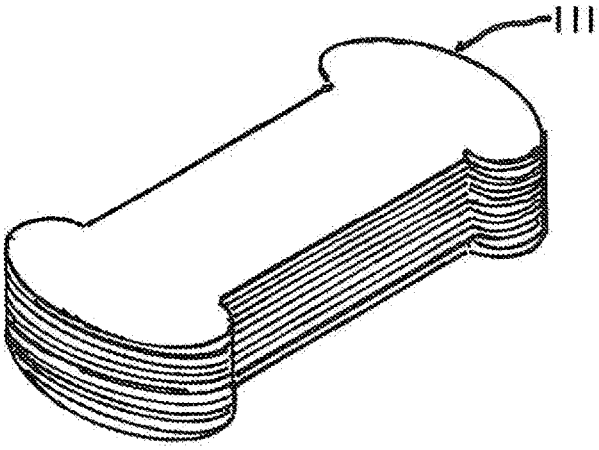
FIGS. 7A-D are an isometric views of an electrically powered three-dimensional target in accordance with an example embodiment of the invention.
Figure 7B:
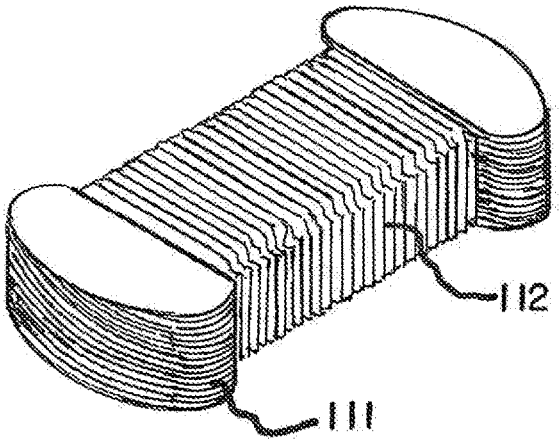
Figure 7C:
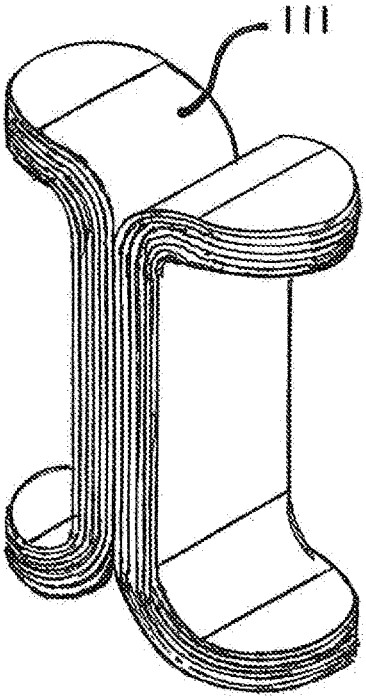
Figure 7D:
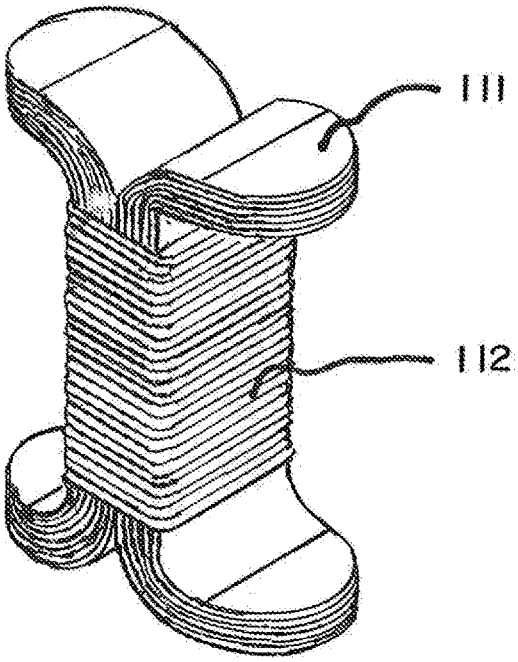

Referring now specifically to FIGS. 4A-4B, in one embodiment, the magnetic field 110 of the target 100 can be manipulated such that it will freely attract external ferromagnetic playing pieces 400 when the target 100 is switched in the "ON" position. Alternatively, the target 100 will not readily attract ferromagnetic playing pieces 400 when switched to the "OFF" position. This is accomplished by mechanically reorienting permanent magnets 101 with respect to a series of ferromagnetically permeable spacers 131 and ferromagnteically resistive spacers 130.

Referring now to FIGS. 7A-7D, the target 100 can be constructed of one or more electrical elements capable of producing a magnetic field 110 when energized. In this embodiment, a soft iron core 111 is wrapped with a plurality of turns of electrically conducting wire 112 such that a magnetic field is established through, and directed by, the iron core 111 when electricity flows through the coil of wire 112. The core 111 may have laminations when energized by alternating current electricity or may have either laminations or solid when the coil of wire 112 is energized by direct current. A plurality of coils may be stacked, end-to-end to achieve an active magnetic surface across the entire surface of the target 100.

In another embodiment, the magnetic field 110 of the target 100 can be established electrically by powering an electric coil of wire 112 wrapped around a ferromagnetic core 111. Additionally, this feature can be used to cause the magnetic field 110 to change in orientation or intensify during the game play without being outwardly obvious to the players. In any case, the feature may be used to allow playing only within a specified window of time. The timing aspect is important so that each game set may be metered and playing time is not monopolized by a single player or team. Additionally, a monetary or other value can be assigned to the pre-established play time.

Figure 8:
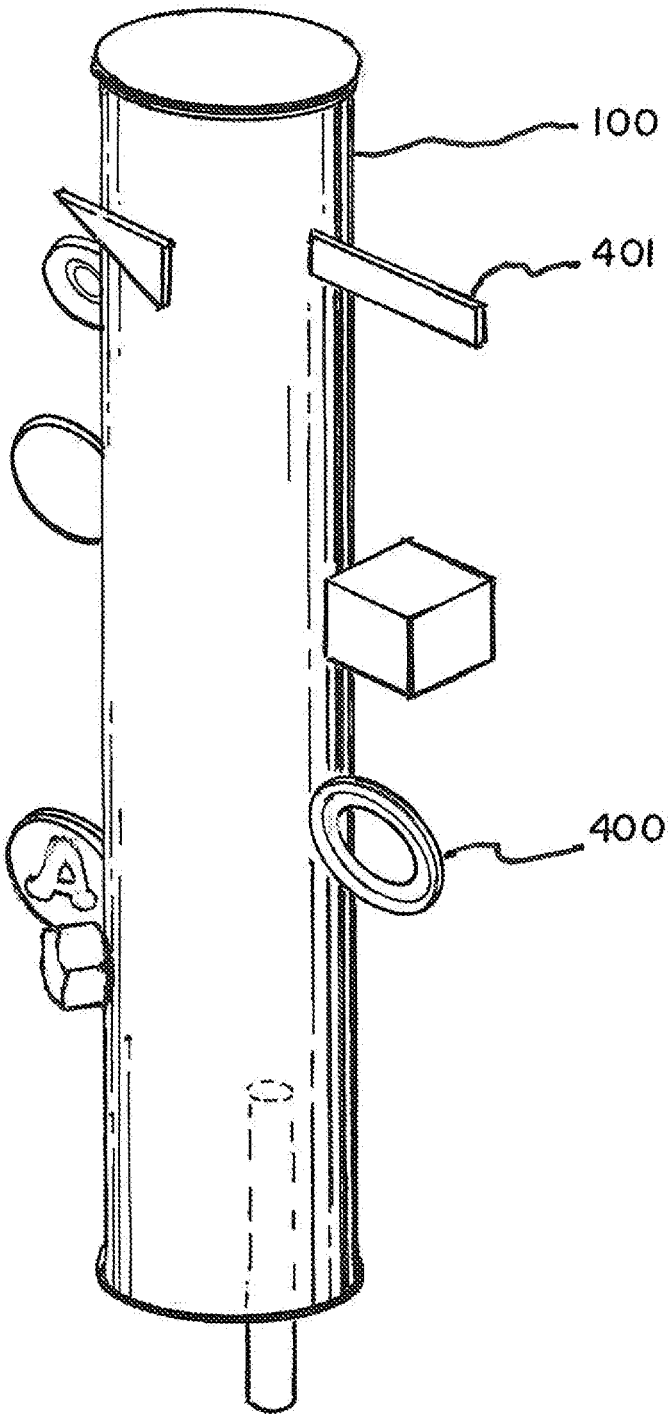
FIG. 8 is an isometric view of a three-dimensional target with a plurality of obstacles and/or or varied playing pieces surrounding it in accordance with an example embodiment of the invention.
Figure 9:
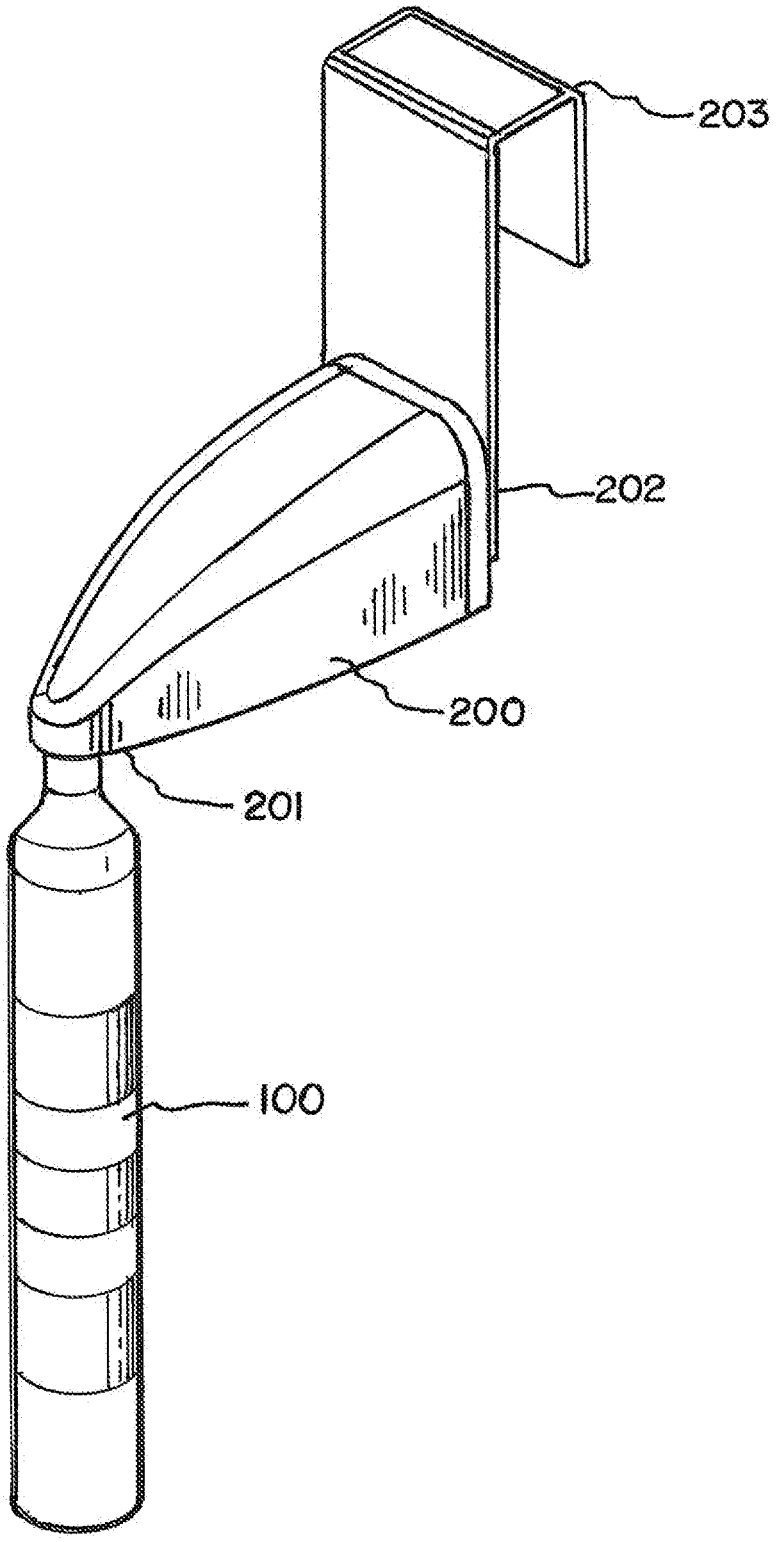
FIG. 9 is an isometric view of a support mechanism in accordance with an example embodiment of the invention.

In one embodiment, the three-dimensional target 100 can be shaped or printed in a manner to promote a particular theme such as a sports theme or to advertise products or services. In another embodiment, one or more obstacles 401 can surround target 100 for the purpose of changing the magnetic field 8 and/or altering the three dimensional surface of target 2 (see FIG. 8).

Asymmetry of the target 100 and regions which are more or less available to receive a playing piece 400 to finally adhere may result in increased game challenge and excitement. This feature coupled with the asymmetry of the playing pieces can affect the landing orientations to the target when the playing piece is attracted to the target and can additionally enhance the game challenge. In all embodiments, the target may be printed with advertising or other features as desired by the sponsor or players of the game.

Referring to FIGS. 9-12, support mechanism 200 has two ends 201 and 202. In one embodiment, the first end 201 of the support mechanism 200 is operably coupled to the three-dimensional target 100 and the second end 202 is affixed to a hanging device 203, wherein the support mechanism 200 and target 100 can be suspended from a fixed object such as a door, ledge, shelf, or other similar structure. The hanging device 203 can include one or more hooks, eye screws, removable adhesive holders, suction cup devices, tripods, or clamps.

Figure 11:
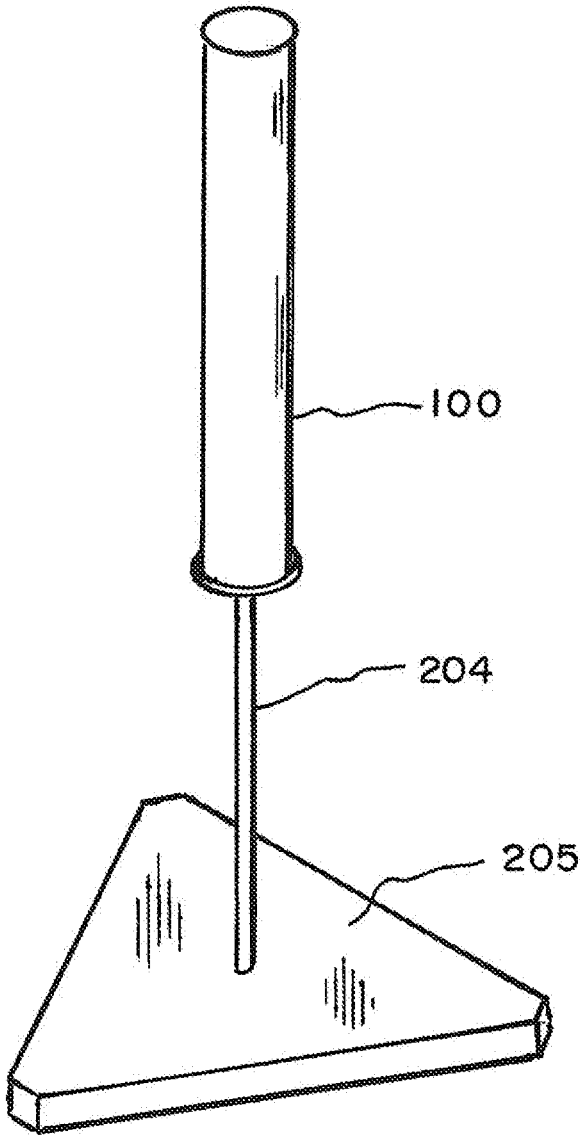
FIG. 11 is an isometric view of a table mounted support mechanism in accordance with an example embodiment of the invention.
Figure 12:
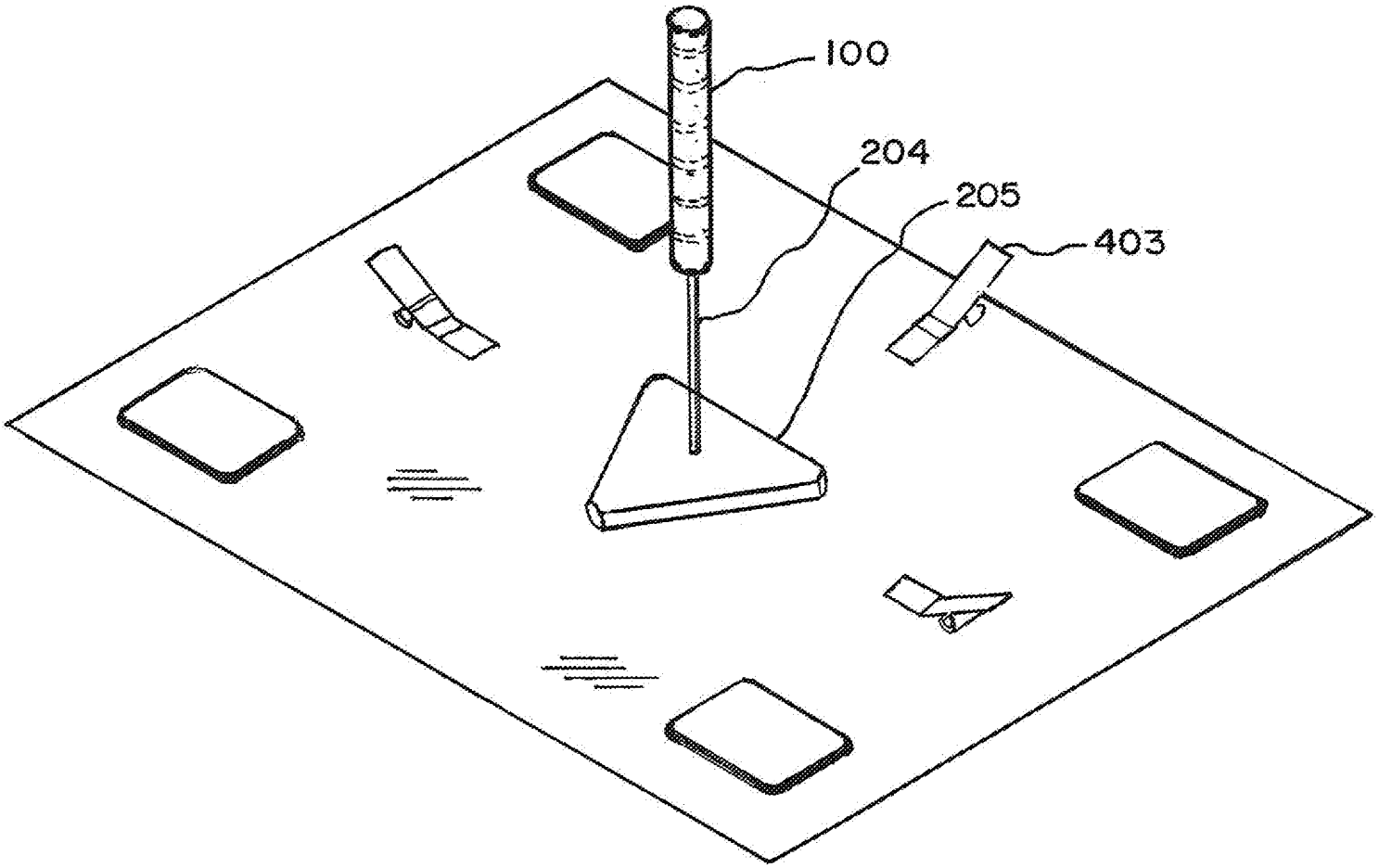
FIG. 12 is an isometric view of a table mounted support mechanism and game set-up in accordance with an example embodiment of the invention.

In another embodiment, the magnetic toss game 100 sits upright relative to a fixed reference point, for example being positioned on top of a table (see FIG. 11, FIG. 12). Accordingly, the target 100 is placed upon a vertical rod 204 received within a base 205, wherein the target 100 is a freestanding object for which game players will toss the game pieces 400 at the target 100.

Figure 10:
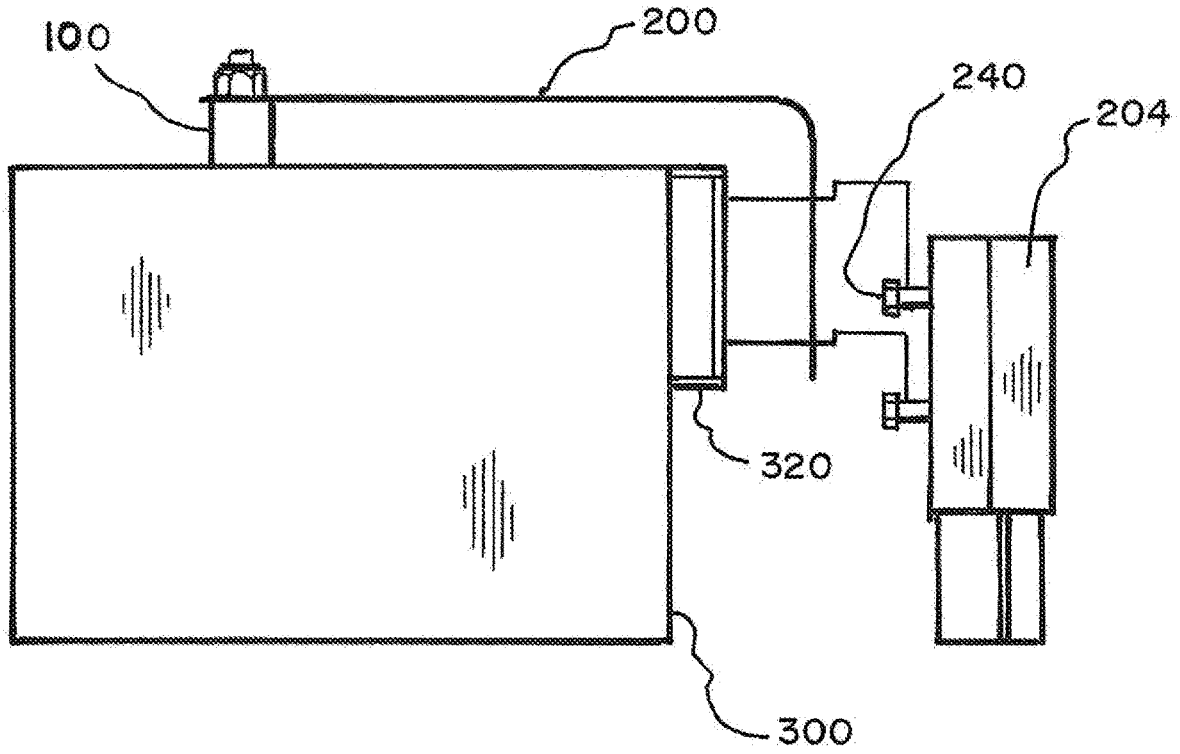
FIG. 10 is a side view of showing a connection between the backdrop and target in accordance with an example embodiment of the invention.
Figure 11B:
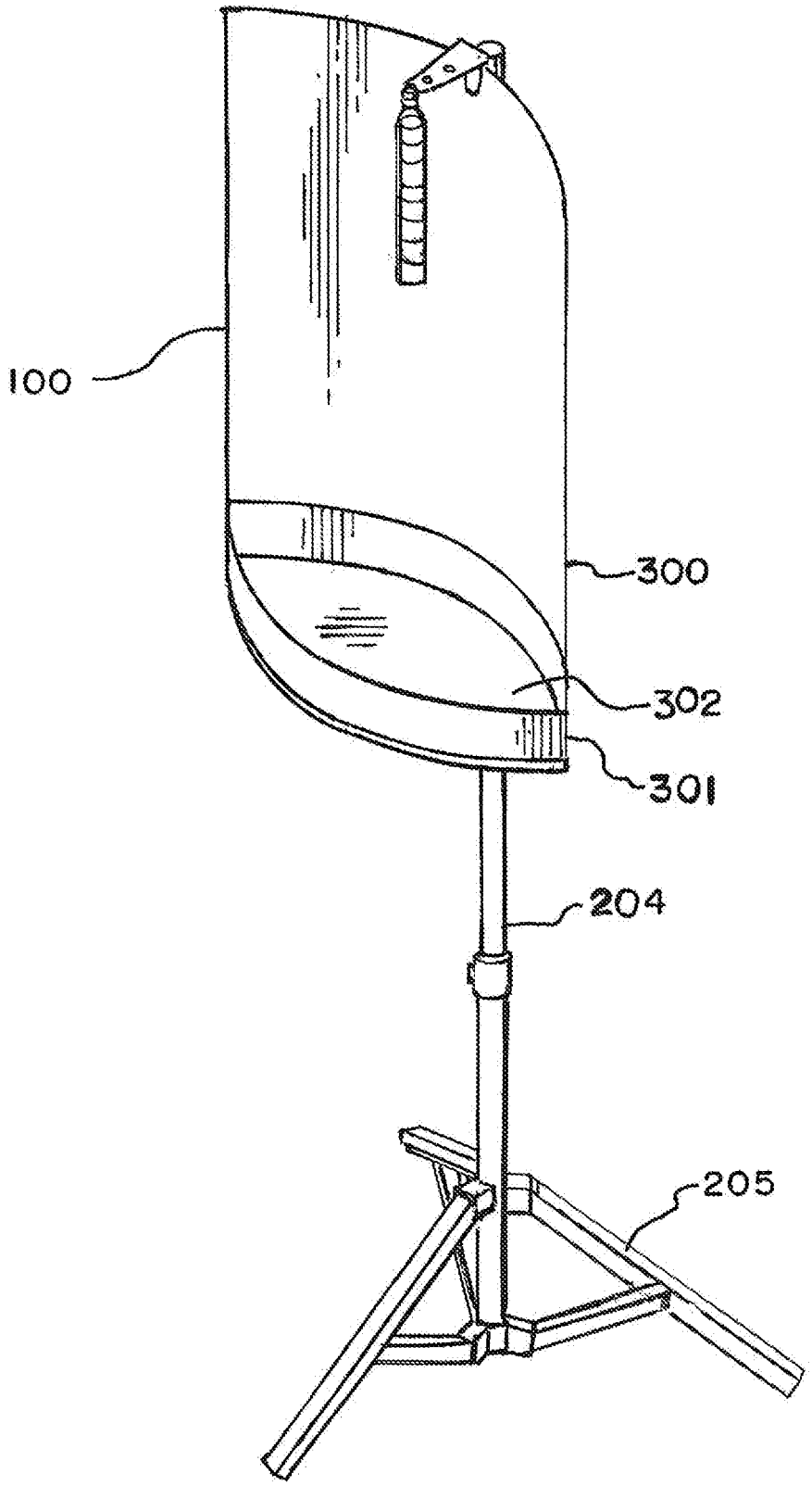
FIG. 11B is an isometric view of a floor mounted support mechanism including the backdrop device for catching playing pieces, in accordance with an example embodiment of the invention.

In a preferred embodiment of the present invention as shown in FIG. 10 and FIG. 11B, the target 100 is affixed to the support 200 with the target 100 partially surrounded by the backdrop 300. In this configuration, the support 200 includes apertures to receive a pin 240 on an end of the vertical rod 204 with the pin 240 received in a clasp 320 located on a rear of the backdrop 300 and wherein, the support 200 is sandwiched between the clasp 320 and the pin 240 on the vertical rod 204. According to this embodiment, the vertical rod 204 is preferably an adjustable tripod.

As is shown in FIG. 12, the magnetic toss game 10 of the present invention can be configured for play on a table surface. Accordingly, a mat may be placed on the surface and the target 100 positioned on the rod 204 supported by the base 205 in a vertical position. Players would take turns tossing the playing piece 400 at the target 100. According to this configuration for game play, the playing piece 400 may be flipped at the target 100 utilizing a flipping device 403, wherein a user will place the playing piece onto the flipping device 403 and strike the flipping device 403 to propel the playing piece 400 towards the target 100.

In another embodiment, the attachment mechanism includes a lazy Susan so that the magnetic toss game can be turned to face different directions. The lazy Susan can be motorized. In yet another embodiment, the magnetic toss game is attached to a vertical fixed reference point, for example being clamped to a vertical pole. In yet another embodiment of the invention, the target itself is used as its own support and the target may be placed on a table, shelf or the floor. In another embodiment, the target has features that make it possible to physically attach to a supporting member such as an eyelet, hook or other feature designed to secure the target to a reference point. In another embodiment, the target may be magnetically affixed to a point of reference such a ferromagnetic plate on the wall, or, an automobile body panel.

Referring to FIG. 1 and FIG. 11B, the backdrop 300 has at least one side surface and a bottom surface 302. The backdrop 300 is typically spaced apart from the three-dimensional target 100. In one embodiment, at its closest point, the three-dimensional backdrop 300 is typically spaced from between one inch to one foot from the three-dimensional target 100. The three-dimensional backdrop 300 may be operably coupled to the support mechanism 200. The three-dimensional backdrop 300 can be configured in a variety of shapes and sizes, and can be printed or constructed in a variety of materials to promote a particular theme or advertise products or services, as well as other marketing opportunities. The backdrop 300 is generally intended to capture and consolidate tossed pieces 400 that did not adhere to the target 100.

The bottom surface 302 of the three-dimensional backdrop 300, preferably includes a flexible rib 301. The flexible rib 301 configured of a rigid and flexible material adhered to the backdrop 300 to form a tray. The tray designed for the collection and receipt of tossed playing pieces 400 that miss the target 100. The backdrop 300 and tray can be easily folded for transport and used to encompass the target 100, playing pieces 400, and support stand 200, wherein the backdrop 300 forms an enclosure for the transport of the game 10. A secondary feature to the backdrop 300 is to create an optical illusion to obscure the target 100 and/or used to project part of the game 10. For example, the three-dimensional backdrop can resemble a beer can or bottle, football, baseball bat, or basketball. As another example the backdrop 300 could be made to resemble a baseball field, soccer field, racetrack, baseball bat, basketball, store logo, college/NFL/NHL/NBA licensing agreements, or a band logo. In one embodiment, a projector projects a moving image on the backdrop 300. In another embodiment, the backdrop 300 contains lightable elements such as LEDs to decorate the backdrop or enhance the general theme of the particular installation. In the case of LED lighting, the LED lights may be sequenced to obscure the playing environment field of view, indicate a response from a particular play such as a cheer response when a playing piece is landed, represent game features such as a goal post or goal line or facilitate an advertisement.

Various parts of the magnetic toss game 10, including the target 100 and backdrop 300 can be lighted. The lights can have different colored shapes and/or magnetic intensity that can affect scoring of the game. For example, different colored lights can be used to indicate time and where the players need to toss a playing piece 400 for maximum point value. Lights can be on or off for different durations of time to affect the scoring of the game. Lighted feature affects the cadence/speed of the game with different colored lights.

Various parts of the magnetic toss game 10, including the target 100, can include one or more devices for creating sound associated with the game. For example, in one embodiment, the target 100 can respond to impact of playing pieces 400 landing on the target 100 with different audible indications to cheer, boo, and/or provide feedback to the players. In another embodiment, the target 100 can count playing pieces 400 by detecting a sound on impact, by measuring a weight increase, by detecting an object passing a light curtain around the target either individually or in a combined manner. In another embodiment, scoring of the playing pieces 400 can have an optical recognition program for playing pieces that are successfully attracted to the target. In yet another embodiment, the playing pieces 400 can have a RFID chip associated with the playing piece 400 such that a receiver in the target 100 can detect the presence of the playing piece 400 near the target 100. In this case, the game can also distinguish the player or team that landed the piece 400. Playing pieces 400 that localize to the target 100 can have their orientation determined as well as time being counted as another scoring factor. In another embodiment, users can record own sounds for playback during the use.

The magnetic toss game 10 can include least one metalized or ferromagnetic piece 400. In one embodiment, the metalized or ferromagnetic piece 400 can be a bottle cap. In another embodiment, the metalized or ferromagnetic piece 400 can be a disk shaped token. In another embodiment, the metalized or ferromagnetic piece 400 can be in a shape other than a disk, such as a triangle, square, trapezoid, oval, semi-spherical, elliptical, trapezoid and three dimensional embodiments of geometric shapes. Playing pieces 400 can also be constructed by assembling several elemental shapes to form a final playing piece. Asymmetry of the playing piece 400 can affect the aerodynamic aspects of the playing piece as it tossed. Asymmetry of the playing pieces 400 can affect the landing orientations to the target 100 as the playing piece is attracted to the target 100. In one embodiment, the token 400 is magnetized. Token 400 can be colored or numbered for teams or individual play. Token 400 can be printed with advertising to promote a particular product or service.

When the magnetic toss game 10 is in use, the bottom of the three-dimensional target 100 is generally positioned from 4-6 feet off the ground. The backdrop 300 of the target is generally positioned behind the target with respect to the player. Individuals playing the magnetic toss game 10 can generally stand seven feet from the target when throwing their playing pieces.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the specification and claims.

What is claimed is:

1. A magnetic toss game, the game structure comprising:

a three-dimensional magnetic target, the three-dimensional magnetic target stationary and positioned in a vertical position relative to a ground surface, the three-dimensional magnetic target comprised of:

a permanent magnet;

a magnetically permeable spacer, the magnetically permeable spacer positioned adjacent to the permanent magnet; the permanent magnet and magnetically permeably spacer capable of generating a magnetic field around all sides of the three-dimensional magnetic target including the entirety of perimeter; and an external covering surrounding an exterior surface of the three-dimensional magnetic target, the external covering having magnetically permeable and magnetically impermeable regions, wherein the external covering blocks the magnetic field in distinct regions providing the three-dimensional magnetic target with both magnetic regions and nonmagnetic regions; and a ferromagnetic game piece, the ferromagnetic piece capable of adhering to the three-dimensional magnetic target when tossed to a position near the three-dimensional magnetic target, wherein the ferromagnetic game piece can be adhered in multiple positions around all sides including the perimeter of the three-dimensional magnetic target.

2. A magnetic toss game as in claim 1, wherein movement of the external covering alters the magnetic field of the three-dimensional magnetic target.

3. A magnetic toss game as in claim 1, wherein movement of the three-dimensional magnetic target and the magnetically permeable portion of the external covering alters the magnetic field emanating from the three-dimensional magnetic target.

4. A magnetic toss game as in claim 1, wherein the three-dimensional magnetic target is an electromagnet, and wherein the magnetic field of the three-dimensional magnetic target can be selectively controlled.

5. A magnetic toss game as in claim 1, wherein the ferromagnetic game piece is a bottle cap.

6. A magnetic toss game, the game structure comprising:

a magnetic target, the magnetic target being stationary and having a three-dimensional shape capable of generating a magnetic field around all sides including an entire perimeter, the magnetic target comprising:

a permanent magnet;

a magnetically permeable spacer, the magnetically permeably spacer positioned adjacent to the permanent magnet; and an external covering surrounding an exterior surface of the magnetic target, the external covering having permeable and impermeable regions;

a support mechanism, the support mechanism having:

a first end, the first end operably coupled to the magnetic target to support the magnetic target in a vertical position; and a second end;

a ferromagnetic game piece, the ferromagnetic piece capable of adhering to the magnetic target when tossed to a position near the magnetic target around all sides including the entire perimeter of the magnetic target; and a backdrop, the backdrop spaced apart from the magnetic target and operably coupled to the support mechanism, the backdrop having:

at least one side surface; and a bottom surface, the bottom surface forming a tray for the receipt of tossed ferromagnetic game pieces that do not magnetically adhere to the magnetic target, wherein the three-dimensional backdrop envelops the magnetic target on the at least one side and the bottom side.

7. A magnetic toss game as in claim 6, wherein movement of the external covering alters the magnetic field emanating from the magnetic target.

8. A magnetic toss game as in claim 6, wherein movement of the magnetic target and magnetically permeable portion of the external covering selectively alters the magnetic field emanating from the magnetic target.

9. A magnetic toss game as in claim 6, wherein the magnetic target is an electromagnet, and wherein the magnetic field of the magnetic target can be selectively controlled.

10. A magnetic toss game as in claim 6, wherein the ferromagnetic game piece is a bottle cap.

11. A magnetic toss game as in claim 6, wherein the backdrop includes a rib, the rib forming a rim for the tray at the bottom side of the backdrop.

12. A magnetic toss game as in claim 11, wherein the backdrop operates as a carrying case for the game.

13. A magnetic toss game as in claim 6, wherein the support mechanism is a vertical pole.

14. A magnetic toss game as in claim 6, wherein the support mechanism is coupled to a hook, the hook cable of hanging the game from a door.

* * * * *